United States Patent [19]

Kashihara et al.

[11] 4,259,615

[45] Mar. 31, 1981

[54] PHOTOGRAPHIC FLASH DEVICE

[75] Inventors: Toshitsugu Kashihara, Nara; Kazuo Tanaka, Neyagawa, both of Japan

[73] Assignee: West Electric Company, Ltd., Osaka, Japan

[21] Appl. No.: 19,403

[22] Filed: Mar. 12, 1979

[30] Foreign Application Priority Data

Mar. 20, 1978 [JP] Japan ..... 53-31853

[51] Int. Cl.[3] ..... H05B 41/32

[52] U.S. Cl. ..... 315/241 P; 315/133; 315/135; 354/127

[58] Field of Search ..... 315/241 P, 133, 135, 315/136; 354/127; 320/1, 48; 340/660

[56] References Cited

U.S. PATENT DOCUMENTS 3,714,872 2/1973 Mashimo et al. ..... 315/241 P X 3,831,079 8/1974 Iwata ..... 315/241 P X

FOREIGN PATENT DOCUMENTS 2441089 3/1976 Fed. Rep. of Germany ..... 315/133

OTHER PUBLICATIONS

*Electronic Indicator,* Electronic Engineering, vol. 46, No. 55, Apr., 1974, p. 11.

*Primary Examiner*—Eugene R. LaRoche

*Attorney, Agent, or Firm*—Cushman, Darby & Cushman

[57] ABSTRACT

A photographic flash device comprising a main capacitor for flashing a flash discharge tube, a DC-DC converter, a constant-voltage circuit for controlling the oscillation function of the DC-DC converter and an indication means capable of discriminatively indicating states of the voltage of the main capacitor in three different voltage ranges, first range being from zero to a first predetermined voltage above which flashing is possible, second range being from a first predetermined voltage to a second predetermined voltage, the third range being from the second predetermined voltage to a third predetermined maximum voltage, respectively.

20 Claims, 4 Drawing Figures

PHOTOGRAPHIC FLASH DEVICE

BACKGROUND OF THE INVENTION

1. Field of the Invention

This invention relates to a photographic flash device comprising a constant-voltage source which controls oscillation function of a DC-DC converter and makes a charging voltage of a main discharging capacitor constant. It is more particularly directed to an apparatus having a function of indicating states of the charging voltage value of the main discharging capacitor in the photographic flash device.

2. Prior Art

In the conventional photographic flash device (hereinafter referred to strobe), one typical type of the indication apparatus for the charged voltage value of the main discharging capacitor is so devised that an indication device such as neon tube is connected to the main discharging capacitor in parallel. Indication operation for the charging voltage of the main discharging capacitor is made in accordance with states whether the indication device lights up or not. In such conventional indication apparatus the indication device lights up when the voltage across the main discharging capacitor rises up to a specified value which is usually the minimum voltage necessary for strobe action. But it is not possible to detect to what value the voltage of the main discharging capacitor rises after passing the minimum voltage of the main discharging capacitor. Therefore, there has been an uncontrollable factor in the strobe action. In other words, amount of the flashed light differs depending on the progress of charging of the main discharging capacitor. For example, the charged voltage which is immediately after the lighting of the indication device is considerably lower than that when the main discharging capacitor is fully charged after a lapse of a long time from the lighting. This fact reflects to a problem of undesirable variation of the amount of flashed light, and thus no uniform flashing can be expected.

In order to solve the abovementioned problem, a photographic flash device was proposed and disclosed in the specification of U.S. Pat. No. 3,831,079 to West Electric Co., Ltd. In the photographic flash device of the U.S. Patent, a DC-DC converter is made to intermittently oscillates when the charged voltage of the main discharging capacitor rises up to a specified value, and thus the charging voltage of the main discharging capacitor is held at a constant value. Simultaneously, a light emitting display device such as electroluminescence and light emitting diode, which is connected to the DC-DC converter, begins blinking. In such device, when the flash tube is lighted up during the blinking operation of the light emitting display device, amount of the flashed light is always constant since the charged voltage across the main discharging capacitor is held at the constant value. Therefore, by making a flash during the period of the blinking, the photographic flash device can be free from the problem in the variation of the flashed light amount. But when strobe action is urgently required and hence is made when the charging voltage does not yet reach the final constant value though higher than the minimum voltage for flashing, the amount of the flashed light is an uncertain one which is lower than the constant value. Therefore, the amount of the flashed light is beyond control. This is due to the fact that the voltage indication by the conventional light emitting display device can indicate only one state that the voltage of the capacitor is above a preset value.

SUMMARY OF THE INVENTION

The present invention provides a photographic flash device comprising an indication apparatus which can indicate states of the voltage of the main discharging capacitor by discriminating into three different voltage ranges.

PREFERRED EMBODIMENT

This invention provides a photographic flash device comprising a main discharging capacitor to be charged by a DC-DC converter for giving a flashing energy to a flash discharge tube, a constant-voltage circuit for controlling an oscillation function of the DC-DC converter, a first detection circuit to detect a first charging voltage of the main discharging capacitor, a first switching means being connected to the first detection circuit and being turned on by an output signal of the first detection circuit when a voltage of said main discharging capacitor rises up to the first charging voltage, a first light emitting display device connected in series to the first switching means, a second detection circuit detecting a second charging voltage higher than the first charging voltage of the main discharging capacitor, a second switching means to be turned on by an output signal of the second detection circuit when the voltage across the main capacitor rises up to the second charging voltage, and a second light emitting display device connected in series to the second switching means. In the abovementioned device, the first light emitting display device emits light at the first charging voltage, the first light emitting display device stops emitting the light and the second light emitting display device emits light at the second charging voltage, and the first and the second light emitting display devices alternatively emit the light after the constant-voltage source begins its operation.

Figure 1:
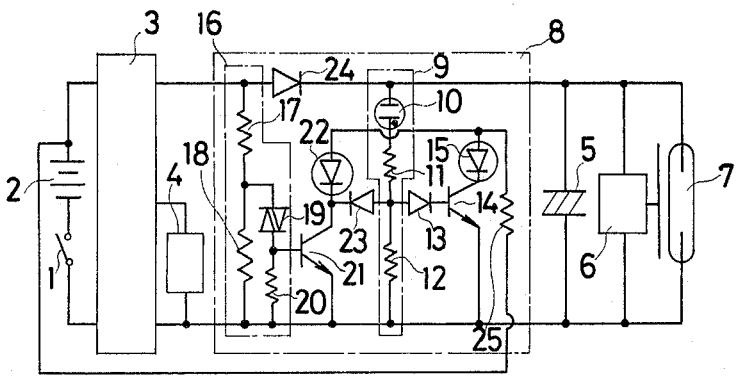
FIG. 1 is an electric circuit diagram of first embodiment of a photographic flash device in accordance with the present invention.

A first embodiment of the photographic flash device in accordance with the present invention is shown in FIG. 1. The device has a power switch 1, an electric power source 2, a DC-DC converter 3 including a buffer capacitor therein, a constant-voltage circuit 4 connected to be fed by the DC-DC converter 3, a main discharging capacitor 5, a trigger circuit 6 for a flash discharge tube 7, and a display apparatus 8 both connected to be fed by the DC-DC converter 3. The display apparatus 8 has a first detection circuit 9, a first display means comprising a transistor 14 for lighting a first light emitting diode (LED) 15 at a voltage over a first preset voltage, a second detection circuit 16, a second display means comprising a transistor 21 for lighting a second light emitting diode (LED) 22 at a voltage over a second preset voltage, and a resistor 25 to feed appropriate amount of current to the LEDs 15 and 22.

The first detection circuit 9 has a neon tube 10 and resistors 11 and 12, and detects a time when a voltage across the main discharge capacitor 5 reaches the minimum voltage value necessary for the strobe action. This voltage is referred hereinafter to a first charging voltage.

The first display means has a diode 13, the first LED 15 (e.g. red color LED) and the transistor 14. The transistor 14 is a first switching element, which is controlled by an output signal of the first detection circuit 9, controls the operation of the first LED 15.

The second detection circuit 16 has resistors 17, 18 and 20, and a thyristor 19 (for example, DIAC) which has a specified value of the breakover voltage. The second detection circuit 16 detects a time when a voltage of the main discharge capacitor 5 reaches a specified voltage slightly lower than the maximum charging voltage.

The second display means has a diode 23, the second LED 22 (e.g. green color LED), the transistor 21 and a diode 24. The transistor 21 is a second switching element, which is controlled by an output signal of the second detection circuit 16, controls the operation of the second LED 22. The diode 24 is connected to prevent a backward flow of the stored electric charges in the main discharging capacitor 5 into the second detection circuit 16.

The resistor 25 is connected between two LEDs 15 and 22 and one terminal of the power source 2 so as to feed a specified current to the LEDs 15 and 22.

The neon tube 10, which detects the voltage variation in the first detection circuit 9, lights up when the voltage of the main discharging capacitor 5 reaches the first preset voltage. The thyristor 19, which detects the voltage variation in the second detection circuit 16, breaks over by a voltage across the resistor 18 when the voltage of the main discharging capacitor 5 reaches the second preset voltage.

For the first detection circuit 9 and the second detection circuit 16, any other known voltage detection circuit can also be used. For example, such voltage detection circuit can be so devised that a divided voltage across a dividing resistor directly controls the switching element such as the transistor 14 and the transistor 21.

Function of the photographic flash device of FIG. 1 is elucidated in detail in the following. When the power switch 1 is turned on, the electric power source 2 is connected to the DC-DC converter 3 and then charging of the main discharging capacitor 5 begins. When the voltage across the main discharging capacitor 5 reaches the first preset voltage, current flows through the neon tube 10 and the neon tube 10 in the first detection circuit 9 lights up. The current flowing through the neon tube 10 and the resistors 11 and 12 results in a voltage drop across the resistor 12. This drop voltage is impressed across the base and the emitter of the transistor 14 through the diode 13 and the base current of the transistor 14 flows through the diode 13 thus turning on the transistor 14. Accordingly, current flows in a loop consisting from the electric power source 2, the resistor 25, the first LED 15 and the transistor 14 so that the first LED 15 lights up. By suitably selecting the characteristics of the transistors 14 and 21 and the diodes 13 and 23, only the transistor 13 is turned on while the transistor 21 is still off. This lighting of the first LED 15 indicates the fact that the voltage of the main discharging capacitor 5 reaches the first preset voltage.

When the main discharging capacitor 5 is further charged and the voltage across the main discharging capacitor 5 reaches the second preset voltage, then the thyristor 19 breaks over due to the drop voltage by the resistor 18 which divides the charging voltage. Accordingly, current flows through the thyristor 19 and the resistor 20, and the drop voltage across the resistor 20 is impressed between the base and the emitter of the transistor 21 thus turning on the transistor 21. Accordingly, current flows in a loop made of the electric power source 2, the resistor 25, the second LED 22 and the transistor 21. By means of the turning on of the transistor 21, the base current of the transistor 14 through the diode 13 is eliminated. Therefore, the transistor 14 is turned off, thus the first LED 15 stops the light emission. On the other hand, the second LED 22 lights up at this stage of charging, i.e. when the voltage of the main discharging capacitor 5 reaches the second predetermined voltage.

When the voltage of the main discharging capacitor 5 further increases and becomes a specified value higher than the second preset voltage, the constant-voltage circuit 4 operates which controls the oscillation function of the DC-DC converter 3. As is well known, the constant-voltage circuit 4 turns on and off the oscillation circuit of the DC-DC converter 3 and at the same time makes the charging voltage supplied by the DC-DC converter 3 constant.

When the oscillation of the DC-DC converter 3 stops, the output voltage of the DC-DC converter 3 inevitably becomes zero and no voltage is applied to the second detection circuit 16, since the diode 24 prevents the backward flow of the charges stored in the main discharging capacitor 5. Accordingly, the thyristor 19 and the transistor 21 turn into the turn-off state. The second LED 22 lights out and the base current of the transistor 14 does not bypass through the diode 23 thereby turning the transistor 14 on. Then the first LED 15 lights up. The first LED 15 was put off when the charging voltage of the main discharging capacitor 5 rose up to the second charging voltage.

When the DC-DC converter 3 restores oscillation, the output voltage of the DC-DC converter 3 is impressed to the second detection circuit 16. When the constant-voltage source 4 is set to make the output voltage of the DC-DC converter 3 at the beginning of oscillation higher than the second predetermined voltage, then the second LED 22 lights up at the same time when the oscillation restores. On the contrary, if the output voltage of the DC-DC converter 3 is set lower than the abovementioned second predetermined voltage, the second LED 22 does not light up until the charging voltage of the main discharging capacitor 5 rises up to the second predetermined voltage.

The abovementioned feeding of the output voltage of the DC-DC converter 3 is continuously controlled by the constant-voltage circuit 4. The operation state of the constant-voltage source 4 is detected by two LEDs 15 and 22. That means, the first LED 15 and the second LED 22 alternatively lights up during the while constant-voltage circuit 4 operates.

Figure 2:
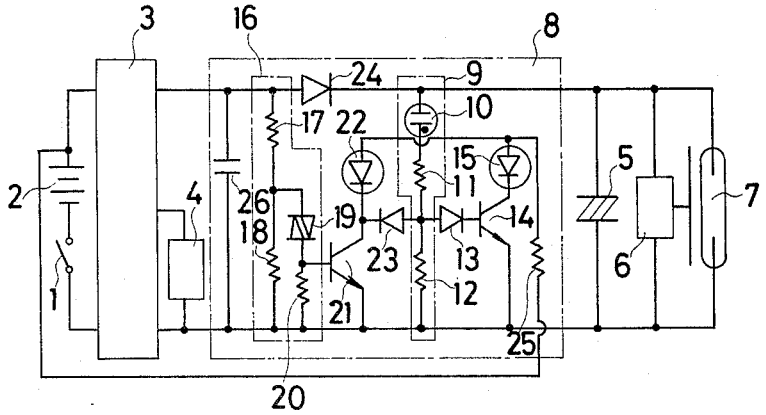
FIG. 2 is an electric circuit diagram of second embodiment of a photographic flash device in accordance with the present invention.

FIG. 2 shows a second embodiment in accordance with the present invention. In this embodiment a capacitor 26 is connected in parallel to a second detection circuit 16 of the same constitution as the one in FIG. 1. Other circuit elements are arranged in the similar manner shown in FIG. 1. The similar operation of the first embodiment is also expected in the second embodiment. A first LED 15 lights up when a voltage of a main discharging capacitor 5 reaches a first preset voltage, and a second LED 22 lights up when the voltage of the main discharging capacitor 5 reaches a second preset voltage. Moreover, an additional operation mode can be obtained by means of the existence of the capacitor 26, during each display operation when the constant-voltage source 4 operates and the first LED 15 and the second LED 22 alternatively light up.

The feature of the operation of the device of FIG. 2 is as follows. In the first embodiment of FIG. 1, when the main discharging capacitor 5 is further charged exceeding the second predetermined voltage so as to have a voltage higher than the second preset voltage and the constant-voltage circuit 4 begins the operation thereof thus stopping the oscillation of the DC-DC converter 3, the voltage impressed to the second detection circuit 16 becomes zero immediately after the oscillation of the DC-DC converter 3 stops thereby turning the transistor 21 off.

However, in the second embodiment, the capacitor 26 is charged before the constant-voltage circuit 4 operates. The charges stored in the capacitor 26 discharge through the second detection circuit 16 immediately after stopping of the oscillation of the DC-DC converter 3; in other words, it takes a certain time before the transistor 21 turns off. Therefore, in the second embodiment the time duration, during which the DC-DC converter 3 does not oscillate, can be set to be longer than the time duration during which the DC-DC converter 3 oscillates. The display operation thus becomes better recognizable than the operation in the first embodiment, since the blinking of the two LEDs 15 and 22 is slow when the first LED 15 and the second LED 22 alternatively light up. Moreover, the capacitor 26 serves to stabilize the output voltage of the DC-DC converter 3, which is impressed to the second detection circuit 16.

Figure 3:
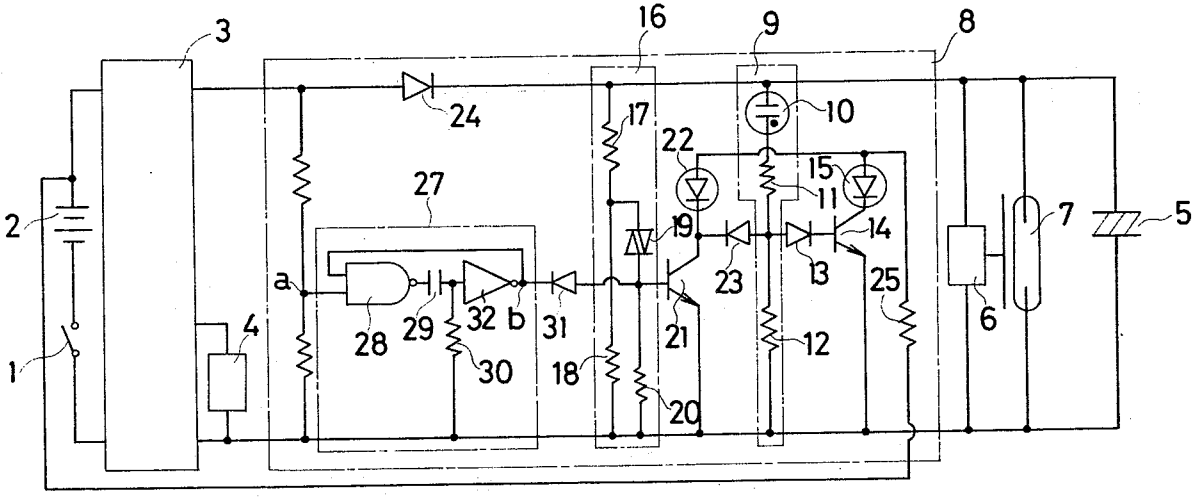
FIG. 3 is an electric circuit diagram of third embodiment of a photographic flash device in accordance with the present invention.

FIG. 3 shows a third embodiment of a photographic flash device in accordance with the present invention. The photographic flash device comprises a monostable multivibrator circuit 27 on top of the example of FIG. 1. Other circuit elements with the same numerals as the example of FIG. 1 are the same elements as those in a first embodiment. As like the operation of the photographic flash device in accordance with the first embodiment, the first LED 15 lights up when the voltage of the main discharging capacitor 5 reaches the first preset voltage and the second LED 22 lights up when the voltage reaches the second preset voltage. The third embodiment has a feature that the light emitting time period can arbitrarily be controlled by the monostable multivibrator circuit 27.

When the main discharging capacitor 5 is charged up to a voltage higher than the second preset voltage and the constant-voltage circuit 4 begins the operation thereof thus stopping the oscillation of the DC-DC converter 3, a voltage logic level at a terminal "a" of a NAND gate 28 in the monostable multivibrator 27 becomes "L" level (low level) by means of the existence of a diode 31. The diode 31 is connected between the base of the transistor 21 and an output terminal "b" of an inverter 32. When the logic level at the terminal "a" becomes "L", the monostable multivibrator circuit 27 operates and the logic level at the output terminal "b" becomes "L" during a time period T determined by the capacitance of a capacitor 29 and the resistance of a resistor 30. Accordingly, the transistor 21 turns off, the second LED 22 is put off and the first LED 15 lights up during the time period T. After lapse of the time period T, the logic level at the output terminal "b" of the monostable multivibrator circuit 27 becomes "H" (high level) and the transistor 21 again turns on so that the second LED 22 lights up.

The time period T can arbitrarily be selected by changing the capacitance of the capacitor 29 and the resistance of the resistor 30. During the time period T the first LED 15 lights up, whereas the second LED 22 is not lit.

In the circuit of FIG. 3, a suitable resistor can be substituted for the diode 13 used for prevention of the backward current flow. There is no substantial difference in the operation of the circuit.

Figure 4:
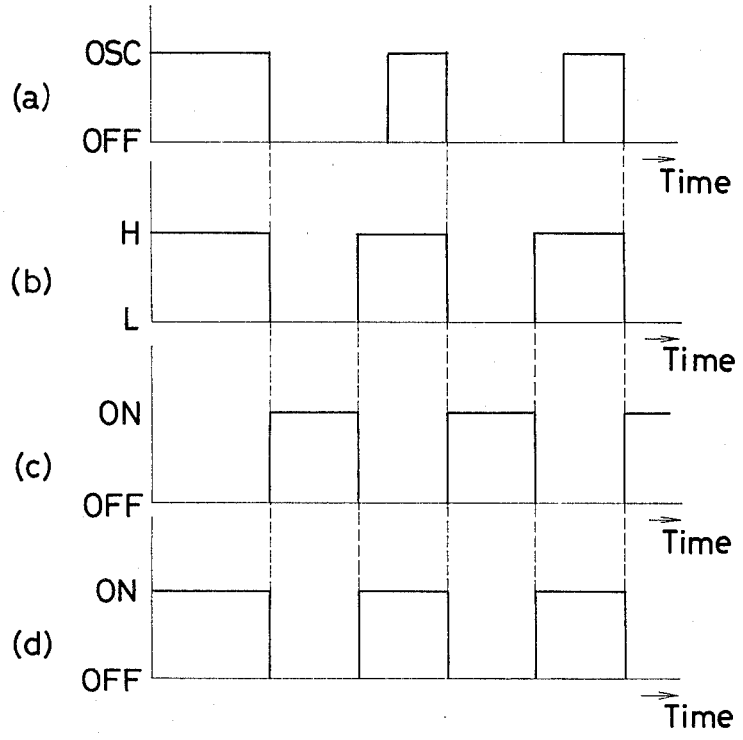
FIG. 4 is a time chart showing operation for several elements of the third embodiment.

FIG. 4 is a timing chart of the operation of the example of FIG. 3, schematically showing states of the several elements. FIG. 4(*a*) shows the oscillation state of the DC-DC converter 3 under the condition that the light emitting time periods of the first LED 15 and the second LED 22 are set to be equal with each other. In this drawing "OSC" designates the state that the DC-DC converter 3 is ocillating and "OFF" the state that the DC-DC converter 3 is stopping oscillation, respectively, FIG. 4(*b*) shows the logic voltage level at the output terminal of the monostable multivibrator circuit 27. FIG. 4(*c*) shows the state "ON" that the first LED 15 is on and the state "OFF" that the LED 15 is off. FIG. 4(*d*) shows the state "ON" that the second LED is on and the state "OFF" that the second LED is off.

As is shown in FIG. 4, after the constant-voltage source 4 begins the operation thereof, the first LED 15 lights up at the time of a stop of oscillation of the DC-DC converter 3 and keeps lighting during the time period T. Then, after lapse of the time period T, the second LED 22 lights up at the time of an inversion of the logic level at the output terminal "b" of the monostable multivibrator circuit 27 from L to H. The second LED 22 is put off at the time of a stop of the oscillation of the DC-DC converter 3. The first LED 15 is put off at the time of an inversion of the logic level at the output terminal "b" of the monostable multivibrator circuit 27. The constant-voltage circuit 4 controls the oscillation starting time of the DC-DC converter 3 in such a manner to make it slightly lag behind the inversion time of the logic level at the output terminal "b" of the monostable multivibrator circuit 27 as shown in FIG. 4(*a*). Therefore, after the inversion of the logic level at the output terminal "b" of the monostable multivibrator circuit 27, the logic level at the input terminal "a" of the NAND gate 28 is held at L and the capacitor 29 is charged up during the time period of this time lag.

The electric power for the first LED 15 and the second LED 22 is supplied by the power source 2. This means, the first LED 15 and the second LED 22 are immediately put off when the switch 1 is turned off, irrespective of the lighting states of two LEDs 15 and 22. When the first LED 15 or the second LED 22 lights up, the strobe is ready for use.

The photographic flash device in accordance with the present invention enables photographings with more controllable amount of light from the flash tube.

What we claim is:

1. A photographic flash device comprising:

a main capacitor to be charged by a DC-DC converter for giving a flashing energy to a flash discharge tube, a constant-voltage circuit for controlling an oscillation function of said DC-DC converter, a first detection circuit for detecting a first predetermined voltage of said main capacitor, a first display means connected to said first detection circuit, for indication of a first state for said first predetermined voltage of said main capacitor and comprising a first light emitting display device and a first switching element connected in series therein, a second detection circuit for detecting a second predetermined voltage higher than said first predetermined voltage of said main capacitor, and a second display means connected to said second detection circuit, for indication of a second state for said second predetermined voltage of said main capacitor and comprising a second light emitting display device and a second switching element connected in series therein, a backward current preventing means being connected between said first detection circuit and the common connecting point of said second light emitting display device and said second switching element for turning said first switching element off during said second switching element being turned on.

2. A photographic flash device comprising:

a main capacitor to be charged by a DC-DC converter for giving a flashing energy to a flash discharge tube, a first detection circuit for detecting a first predetermined voltage of said main capacitor, a first display means connected to said first detection circuit, for indication of a first state for said first predetermined voltage of said main capacitor and comprising a first light emitting display device and a first switching element connected in series therein, a second detection circuit for detecting a second predetermined voltage higher than said first predetermined voltage of said main capacitor, a second display means connected to said second detection circuit, for indication of a second state for said second predetermined voltage of said main capacitor and comprising a second light emitting display device and a second switching element connected in series therein, a constant-voltage circuit for stopping an oscillation function of said DC-DC converter while the voltage of said main capacitor is between said second predetermined voltage and a third predetermined voltage which is higher than said second predetermined voltage, and a monostable multivibrator circuit for controlling a light emitting time period of said first and said second light emitting display devices.

3. A photographic flash device according to claim 1, wherein said first and second switching elements are transistors.

4. A photographic flash device according to claim 1, wherein a capacitor is connected in parallel to said DC-DC converter.

5. A photographic flash device according to claim 1, wherein said first detection circuit comprises a neon tube and at least one resistor connected in series.

6. A photographic flash device according to claim 1, wherein said second detection circuit comprises a first resistor, a second resistor, a thyristor and a third resistor, said first and said second resistors being connected in series and said thyristor and said third resistor being connected in series, the latter series connection being connected in parallel to said second resistor.

7. A photographic flash device according to claim 1, wherein said constant-voltage circuit stops an oscillation function of said DC-DC converter while the voltage of said main capacitor is between said second predetermined voltage and a third predetermined voltage which is higher than said second predetermined voltage;

said second detection circuit is connected to said DC-DC converter, and said first detection circuit is connected to said main capacitor, the photographic flash device further comprising another backward current preventing means connected between said first and second detecting means in a manner enabling current to flow only from said second detecting means to said first detecting means, for stopping detection by said second detecting means during the period when said oscillation function is stopped by said constant-voltage circuit.

8. A photographic flash device according to claim 2 or 7, wherein said second detection circuit comprises a first resistor, a second resistor, a thyristor and a third resistor, said first and said second resistors being connected in series and said thyristor and said third resistor being connected in series, the latter series connection being connected in parallel to said second resistor.

9. A photographic flash device according to claim 2 or 7, wherein said first detection circuit comprises a neon tube and at least one resistor connected in series.

10. In a photographic flash apparatus having a main discharging capacitor for activating a flash discharge tube in response to a trigger circuit output, said capacitor being charged by a DC-DC converter having the voltage at an output thereof regulated by a constant voltage circuit which alternatively enables and disables an oscillation function of said DC-DC converter when the output voltage substantially reaches a predetermined charging voltage, the improvement comprising:

a first detection circuit connected in parallel across said main capacitor for detecting a first predetermined voltage;

a second detection circuit connected in parallel across said main capacitor for detecting a second predetermined voltage greater than said first predetermined voltage and less than said charging voltage;

a first display means connected to said first detection circuit and thereby enabled for indicating a charge across said main capacitor in excess of said first predetermined voltage;

a second display means connected to said second detection circuit and thereby enabled for indicating a charge across said main capacitor in excess of said second predetermined voltage, said second display means including a first diode connected to said first display means for disabling the operation of said first display means when said second display means is enabled;

a multivibrator circuit connected between the output of said DC-DC converter and said second display means; and a second diode connected between said first and second detection circuits and said multivibrator circuit, wherein said second diode conducts charging current from said DC-DC converter to said main capacitor while the oscillation function of said DC-DC converter is enabled, and wherein said second diode blocks current from said main capacitor to said multivibrator circuit while the oscillation function of said DC-DC converter is disabled, said multivibrator circuit thereby being triggered for disabling the operation of said second display means for a predetermined length of time, and thereafter enabling the operation of said second display means.

11. In a photographic flash apparatus having a main discharging capacitor for activating a flash discharge tube in response to a trigger circuit output, said capacitor being charged by a DC-DC converter having the voltage at an output thereof regulated by a constant voltage circuit which alternatively enables and disables an oscillation function of said DC-DC converter when the output voltage substantially reaches a predetermined charging voltage, the improvement comprising:

a first detection circuit connected in parallel across said main capacitor for detecting a first predetermined voltage;

a second detection circuit connected in parallel across said DC-DC converter for detecting a second predetermined voltage greater than said first predetermined voltage and less than said charging voltage;

first display means connected to said first detection circuit and thereby enabled for indicating a charge across said capacitor in excess of said first predetermined voltage;

second display means connected to said second detection circuit and thereby enabled for indicating an output voltage of said DC-DC converter in excess of said second predetermined voltage, said second displayy means including a first diode connected to said first display means for disabling the operation of said first display means when the operation of said second display means is enabled; and a second diode connected between said first detection circuit and said second detection circuit, wherein said second diode conducts charging current from said DC-DC converter to said main capacitor while the oscillation function of said DC-DC converter is enabled, and wherein said second diode blocks current from said main capacitor to said second detection circuit while the oscillation function of said DC-DC converter is disabled.

12. The apparatus of claim 11 further comprising a capacitor connected in parallel across the output of said DC-DC converter.

13. A photographic flash apparatus comprising:

flash discharge means;

capacitance means for supplying discharge current to said flash discharge means;

trigger means for activating said flash discharge means;

means for supplying charging current from a DC source to said capacitance means;

means for alternatively enabling and disabling the operation of said charging current supply means at a predetermined charging voltage level for making said charging voltage level substantially constant;

first means for detecting a charge across said capacitance means in excess of a first predetermined voltage;

first means responsive to said first charge detecting means for indicating a charge across said main capacitor in excess of said first predetermined voltage;

second means for detecting a charge across said capacitance means in excess of a second predetermined voltage, said second predetermined voltage being greater than said first predetermined voltage and less than said charging voltage;

second means responsive to said second charge detecting means for indicating a charge across said main capacitor in excess of said second predetermined voltage;

means connected between said first indicating means and said second indicating means for inhibiting the operation of said first indicating means when said second indicating means is operative; and means for detecting a disabled condition of said charging current supplying means, said second charge detecting means being responsive to said disabled condition detecting means for disabling the operation of said second display means.

14. The apparatus of claim 13 further comprising multivibrator means connected to said charging current supplying means, wherein said disabled condition detecting means is a diode connected between said multivibrator means and said second charge detecting means for passing a charging current from said charging current supplying means to said capacitance means, and for blocking current from said capacitance means to said multivibrator means when said charging current supplying means is disabled, whereby said multivibrator is triggered and operative to inhibit the operation of said second display means for a predetermined period of time less than a period of time during which said charging current supplying means is disabled, said first indicating means and said second indicating means thereby being alternately and respectively enabled and disabled for substantially equal periods of time.

15. The apparatus of claim 13 wherein said disabled condition detecting means comprises a diode connected between said first charge detecting means and said second charge detecting means for passing a charging current from said charging current supplying means to said capacitance means, and for blocking current from said capacitance means to said second charge detecting means when said charging current supplying means is disabled, whereby the operation of said second display means is inhibited.

16. The apparatus of claim 15, wherein another capacitance means is connected in parallel to said charging current supplying means for permitting the duration during which said charging current supplying means is disabled to be set longer than the duration during which said charging current supplying means is enabled.

17. The apparatus of claim 15, 14 or 16 wherein said second charge detecting means comprises a series connection of a thyristor and at least one resistor, said second indicating means being responsive to a voltage developed across at least one of said at least one resistor.

18. The apparatus of claim 15, 14 or 16 wherein said inhibiting means comprises a diode.

19. The apparatus of claim 15, 14 or 16 wherein said first indicating means comprises a first transistor switch connected to a first light emitting diode, and said second indicating means comprises a second transistor switch connected to a second light emitting diode, said inhibiting means being connected to the base of said first transistor switch and to the collector of said second transistor switch for switching off said first switch when said second switch is switched on 20. The apparatus of claim 15, 14 or 16, wherein said first charge detecting means comprises a neon tube connected in series with at least one resistor, said first indicating means being responsive to a voltage developed across at least one of said at least one resistor.

* * * * *